United States Patent [19]

Montanarini

[11] 4,183,490

[45] Jan. 15, 1980

[54] ARRESTING DEVICE FOR AN ANTENNA PART OF A SPACE VEHICLE

[75] Inventor: Marco Montanarini, Schlieren, Switzerland

[73] Assignee: Contraves AG, Zürich, Switzerland

[21] Appl. No.: 952,948

[22] Filed: Oct. 19, 1978

[30] Foreign Application Priority Data

Oct. 28, 1977 [CH] Switzerland ..... 7713141

[51] Int. Cl.[2] ..... H01Q 1/12

[52] U.S. Cl. ..... 248/291; 343/892

[58] Field of Search ..... 248/278, 279, 281, 291, 248/293, 289 R, 289 A; 343/892

[56] References Cited

U.S. PATENT DOCUMENTS

| | | | |
|---|---|---|---|
| 2,158,612 | 5/1939 | Gordon | 248/289 X |
| 2,200,700 | 5/1940 | Monnia et al. | 248/289 X |
| 2,972,891 | 2/1961 | Elliott | 343/892 X |
| 3,014,679 | 12/1961 | Jepson | 248/278 X |
| 3,295,809 | 1/1967 | Smola | 248/291 |
| 3,845,928 | 11/1974 | Barrett | 248/291 |
| 4,113,216 | 9/1978 | Fuse et al. | 248/291 X |

*Primary Examiner*—J. Franklin Foss

*Attorney, Agent, or Firm*—Werner W. Kleeman

[57] ABSTRACT

A function or operational element which is pivotable about a first axis from a rest position into a work position and articulated at a support or carrier member can be positionally arrested by means of an arresting device. The arresting device comprises a bracket secured to the function element and a pawl pivotable about a second axis. In the arrested position a substantially arcuate-shaped end surface of the pawl contacts at a given point a slide or contact surface of the bracket. Due to the particular arrangement of the second axis to the first axis and the spaced arrangement of the center of the end surface eccentrically to the second axis it is possible to exactly position the function element and to self-lockingly fix such in a predetermined position. This arresting device is particularly suitable for use with automatically pivotable antenna on space vehicles with subsequent self-arresting.

3 Claims, 4 Drawing Figures

FIG. 3
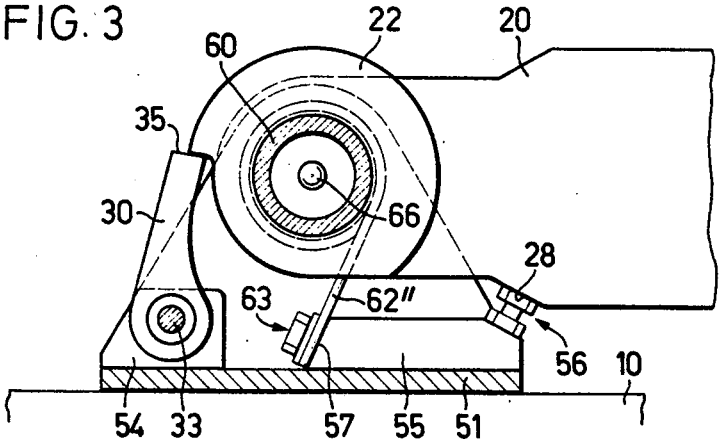
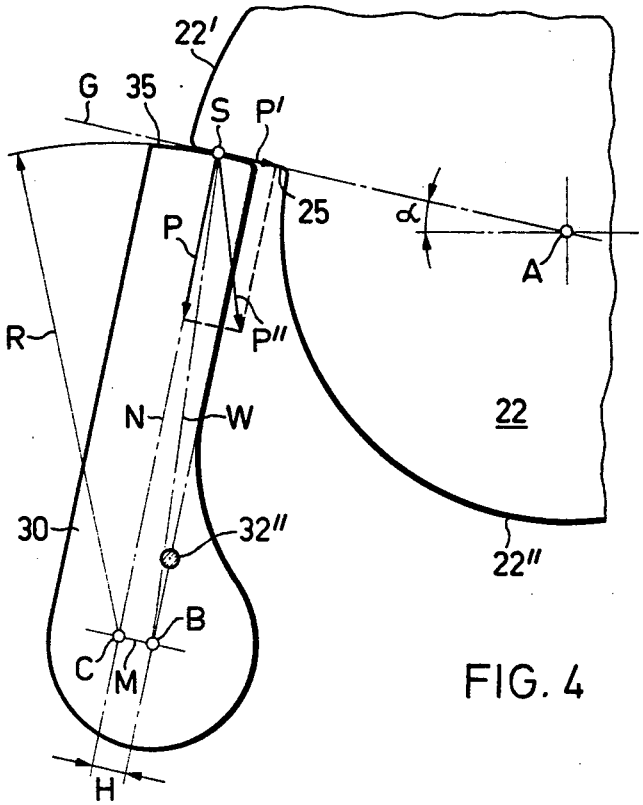
FIG. 4

ARRESTING DEVICE FOR AN ANTENNA PART OF A SPACE VEHICLE

BACKGROUND OF THE INVENTION

The present invention relates to a new and improved construction of arresting device for a function or operational element which is articulated at a carrier or support portion, especially for a function or operational element in the form of an antenna part of a space vehicle, which can be rocked about a first axis out of a rest position into a work position and can be automatically arrested in the work position.

The arresting device of the invention comprises a bracket pivotable about the first axis and operatively connected with the function element and a pawl which is operatively connected with the bracket in the work position and pivotable about the second axis, the pawl having at least one arcuate-shaped end surface.

In West German Pat. No. 2,003,811 there is taught to the art a rod-shaped satellite antenna which is articulated at a satellite body. After removal of a heat shield surrounding the satellite body this satellite antenna can be brought by the action of a spring mechanism into a predetermined position and mechanically stabilized in such position such that a sleeve surrounding the rod-shaped antenna part, after reaching the work position, can be displaced by the force of a spring into the articulated region of the antenna part and surrounds the articulated region, i.e., both hingedly interconnected antenna parts.

SUMMARY OF THE INVENTION

It is a primary object of the present invention to provide an arresting device for a function or operational element, especially for the antenna of a vehicle, articulated at a carrier or support element, this arresting device serving to position and arrest the function part, which is pivotable out of the rest position into the work position, in predetermined position with extreme angular accuracy with regard to the carrier or support element.

Yet a further significant object of the present invention aims at the provision of a new and improved construction of arresting device for selectively arresting in desired position a function part or element, such as an antenna, which arresting device is relatively simple in construction and design, extremely reliable in operation, not readily subject to breakdown or malfunction, and requires a minimum of maintenance and servicing.

Now in order to implement these and still further objects of the invention, which will become more readily apparent as the description proceeds, the arresting device of the present invention is manifested by the features that in a sectional plane, viewed perpendicular to the second axis, the arcuate-shaped end surface of the pawl has a center which is arranged in spaced relationship to the second axis and the bracket has a cooperating slide surface which is directed radially outwardly with regard to the first axis. The slide surface, in the work position of the function element, acts at the point of contact of the pawl and bracket upon the end surface in such a manner that the bracket retains the pawl in its arrested position.

The inventive apparatus has the advantage that the function element pivoted into the work position and still slightly oscillating is pressed, owing to the coaction of the linear slide surface with the arcuate-shaped end surface, into the predetermined position, owing to the automatic post-adjustment, with an angular accuracy of approximately ±0.5°. The bracket retains the pawl in its arrested position and does not again disengage. According to a preferred embodiment the arcuate-shaped end surface of the pawl is formed by an eccentric center starting from the second axis, and during post-adjustment of the pawl the deviation of the angular accuracy of ±0.5° is further additionally extensively eliminated.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 is a sectional view, taken substantially along the line III—III of FIG. 2, showing the arresting device however with the function element rocked or pivoted-out and arrested in position, and FIG. 4 is an enlarged view showing arresting or locking of the function element.

DETAILED DESCRIPTION OF THE PREFERRED EMBODIMENTS

Figure 1:
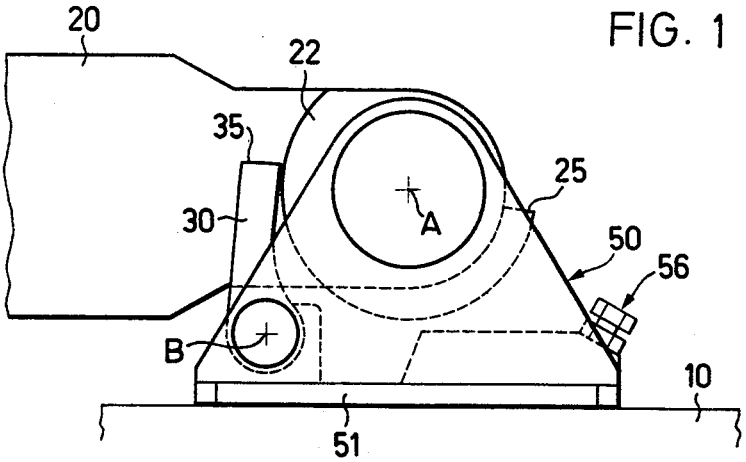
FIG. 1 is a front view of an apparatus for performance of the pivotal movement of a function element shown in its rocked-in position and which apparatus is constructed according to the invention.

Describing now the drawings, in FIG. 1 reference character 10 illustrates part of a platform of a not further illustrated carrier or support element, for instance a satellite body or a space vehicle, at which there is secured by any suitable and therefore not particularly illustrated means a bearing or pillow block 50 constructed for the reception of a pivotal function or operational element 20. As to the function or operational element 20 the same can be, for instance, an antenna or antenna part for a satellite. This function element 20 is pivotably mounted at one end for movement through an angle of about 180° in the bearing block 50, the pivotal motion being accomplished about a first shaft or axis A arranged essentially transversely with respect to the function element 20. Further, the function element 20 can be positionally arrested by a specially designed pawl 30. This pawl 30 is pivotably mounted at a second axis B extending essentially parallel to the axis A.

Figure 2:
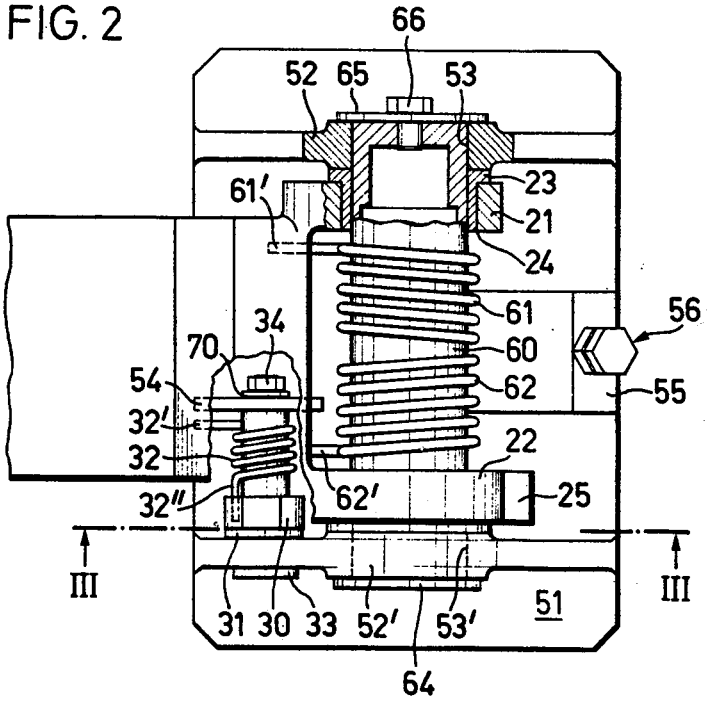
FIG. 2 illustrates the arresting apparatus or device of FIG. 1 in top plan view and partially sectional view.

The function element 20 is structured so that one end thereof is forked or bifurcated and comprises two spaced brackets 21 and 22, as best seen by referring to FIG. 2. These brackets 21 and 22 each have a bore 24 serving for the reception of a bushing or sleeve 23. In the illustrated embodiment the bracket 22, in contrast to the bracket 21, is somewhat larger and designed so as to be stepped or offset. This bracket 22 further has a slide surface 25 at one side which coacts with the pawl 30 in its arrested position. However, there is of course possible designing both of the brackets 21 and 22 so as to be symmetrical and additionally providing and securing at the bracket 22 an appropriately structured disk which coacts with the pawl 30.

The bearing block 50 shown in top plan view in FIG. 2 and partially in sectional view will be seen to comprise a base plate 51, two mutually spaced bearings 52 and 52' attached to the base plate 51. These bearings 52 and 52' each have a respective bore 53 and 53' serving to receive an essentially tubular-shaped axle body 60 defining the axis or shaft A. A socket 55 is approximately provided at the central region of the base plate 51. This socket 55 is structured at one side for receiving an adjustment device 56, for instance composed of a screw and nut. At the opposite side the socket 55 is equipped with a contact and attachment surface 57 for two springs 61 and 62 or equivalent structure arranged between the brackets 21 and 22. The springs 61 and 62 which engage about the axle body 60 are each operatively connected by means of their one respective end 61' and 62' with the function element 20 and at the other end 61" and 62" are secured by appropriately structured attachment means 63 at the surface 57, as best seen by referring to FIG. 3.

The axle body 60 is provided at the one side with a collar 64 which bears at the bearing 52' and is retained in position at the other oppositely situated side by means of a disk or plate 65 bearing at the bearing means or bearing 52 and by a screw 66 or equivalent structure secured in the axle body 60.

In spaced relation and parallel to the bearing means or bearing 52' there is provided at the base plate 51 a further bearing or bearing means 54. Both of the bearings 52' and 54 are structured for the reception of an essentially tubular-shaped axle body 70 forming the axis or shaft B. Mounted upon the axle body 70 is the pawl 30 which is pivotable about the axis B and a spring 32. This spring 32 bears with its one end 32' upon the base plate 51 and at its other end 32" is operatively connected with the pawl 30. The axle body 70 is positionally retained between both of the bearings 52' and 54' by a threaded bolt 33 having a nut or nut member 34. Between the pawl 30 and the bearing 52' there is preferably arranged a slide disk 31.

Now in FIG. 3 there is shown in sectional view, along the line III—III of FIG. 2, the arresting device and there will be seen the function element 20 which is shown rocked through an angle of about 180° about the axis A by means of the force of the springs 61 and 62. This function element 20 bears by means of its beveled or inclined portion 28 at the adjusting device or adjustment means 56. In this position the pawl 30 which has been rocked by the force of the spring 32 about the axis B is in engagement with the slide surface 25 of the bracket 22. Further, there will be recognized from the showing of FIG. 3 the spring end 62" retained by the attachment means 63, the socket 55 and the bearing 54 with the threaded bolt 33 for the mounting of the pawl 30.

In FIG. 4 there is schematically shown, on an enlarged scale, the coaction of the bracket 22 which is pivotable about the axis A with the pawl 30 which is pivotable about the axis B. The particular construction and arrangement of the bracket 22 and pawl 30 and their coaction with one another will be described in greater detail hereinafter.

The bracket 22 (the parts 20 and 22 preferably form a rigid unit) formed in the exemplary embodiment at the function element 20 will be seen to comprise a first, outer segment portion 22' and a second, inner segment portion 22" which is stepped radially with respect to the outer second portion 22' in the direction of the axis A. The segment portion 22' and the segment portion 22" are interconnected by means of the slide surface 25. This slide surface 25 is formed by a linear portion G, the projection of which extends through the center of the axis A at a predetermined angle $\alpha$ and is radially outwardly directed and interconnects both of the segment portions 22' and 22".

The pawl 30 which is pivotable about the axis B will be seen to comprise an end surface 35 confronting the slide surface 25 and having an arcuate-shaped configuration of a radius R. This radius R emanates from a center C which is preferably eccentrically arranged with respect to the axis B. This center C is located at a line M which extends, in the work position, through the center of the axis B and is arranged parallel to the slide surface 25 of the bracket 22. Owing to the coaction of the slide surface 25 with the arcuate-shaped end surface 35, the slide surface 25 being structured as a linear or straight portion, the coefficient of friction effective at the point of contact S is of the same magnitude for each pawl position.

Upon rocking the function element 20 through an angle of about 180° the bracket 22 is effective at the contact point S with a force P, and the pawl 30 which has been pivoted or rocked-in under the action of the spring 32, bearing at a certain coefficient of friction at the slide surface 25, is effective with a force P'. In order to retain the pawl 30 in its rocked-in arrested position, the effective line W extending between the contact point S and through the axis B must be located between a resultant P" of the force components P and P' as well as a line N interconnecting the contact point S with the center C and directed essentially perpendicular to the slide surface 25, i.e., the eccentricity H of the axis B with respect to the center C must be retained as small as possible.

The mode of operation of the described arresting device is essentially as follows: Starting from the rest position, shown in FIG. 1, where the function element 20 is retained by not particularly illustrated means, the pawl 30, under the tension of the spring 32, bears against the outer segment portion 22' of the bracket 22. After reaching the predetermined position of the carrier or support element the function element 20 is rocked, by releasing not particularly illustrated means, through the force of the springs 61 and 62 through an angle of about 180° into the work position, as best seen by referring to FIG. 3. At the same time the pwal 30 latches with its end surface into the slide surface 25 of the bracket 22 due to the force of the spring 32. This force of the spring 32 is dimensioned such that the pawl 30, with appropriate position of the bracket 22, on the one hand, arrives rapidly enough into engagement with the slide surface 25, and on the other hand, the still slightly oscillating function element 20 is pressed, due to post-adjustment, into the predetermined position with an angular accuracy in the order of magnitude of ±0.5°, and with appropriate dimensioning of the eccentricity H there can be further eliminated the deviation of the angular accuracy of ±0.5° during such post-adjustment or positioning.

Due to the particular arrangement of the axis B to the axis A and the center C to the axis B as well as owing to the coaction of the slide surface 25 with respect to the end surface 35 the function element 20 is optimumly positioned as to accuracy and self-lockingly fixed in this position.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An arresting device for a function element, especially an antenna part of a space vehicle, articulated to a support, comprising:

means mounting said function element so as to be pivotable about a first axis out of a rest position into a work position;

means for automatically locking said function element in the work position;

said locking means comprising:

a bracket pivotable about the first axis;

a pawl operatively coacting with the bracket in the work position of the function element and pivotable about means defining a second axis;

said pawl having at least one substantially arcuate-shaped end surface;

said arcuate-shaped end surface of the pawl, in a sectional plane viewed perpendicular to the second axis, having a center arranged in spaced relationship with respect to the second axis;

said bracket having a slide surface radially outwardly directed with regard to the first axis;

said slide surface, in the work position of the function element, acting at a point of contact of the pawl and bracket upon the end surface in such a manner that the bracket retains the pawl in an arrested position.

2. The arresting device as defined in claim 1, wherein: in the work position of the function element an effective line extending through the contact point and the center of the second axis is located between a resultant of the force components and a line interconnecting the contact point with the center.

3. The arresting device as defined in claim 2, wherein: the center arranged in spaced relationship to the second axis is formed by the intersection point of a line directed essentially perpendicular to the slide surface and a line extending parallel to the slide surface through the center of the second axis in the work position of the function element.

* * * * *